US005114470A

United States Patent [19]

Biancaniello et al.

[11] Patent Number: 5,114,470

[45] Date of Patent: May 19, 1992

[54] PRODUCING VOID-FREE METAL ALLOY POWDERS BY MELTING AS WELL AS ATOMIZATION UNDER NITROGEN AMBIENT

[75] Inventors: Francis S. Biancaniello, Gaithersburg, Md.; Gregg N. Janowski, Hoover, Ala.; Stephen D. Ridder, Gaithersburg, Md.

[73] Assignee: The United States of America as represented by the Secretary of Commerce, Washington, D.C.

[21] Appl. No.: 593,915

[22] Filed: Oct. 4, 1990

[51] Int. Cl.[5] ..... B22D 23/00; B22F 9/00

[52] U.S. Cl. ..... 75/338; 75/339; 264/12; 419/66

[58] Field of Search ..... 75/338, 339; 148/11.5 P, 16; 264/12

[56] References Cited

U.S. PATENT DOCUMENTS

| | | | |
|---|---|---|---|
| 2,638,630 | 9/1949 | Golwynne | 18/47.3 |
| 3,658,311 | 4/1972 | Di Giambattista et al. | 264/12 |
| 3,891,730 | 6/1975 | Wessel et al. | 264/11 |
| 4,340,432 | 7/1982 | Hede | 148/11.5 P |
| 4,448,746 | 5/1984 | Kubo et al. | 148/16 |
| 4,626,278 | 12/1986 | Kenney et al. | 75/338 |
| 4,758,405 | 7/1988 | Couper et al. | 75/338 |
| 4,768,577 | 9/1988 | Flinn et al. | 75/338 |
| 4,919,854 | 4/1990 | Walz | 264/12 |
| 4,988,464 | 1/1991 | Riley | 75/338 |

*Primary Examiner*—Upendra Roy
*Attorney, Agent, or Firm*—Michael S. Gzybowski

[57] ABSTRACT

A method of producing nitrogenated metal alloys which involves melting a metal alloy under a nitrogen atmosphere and subsequently gas atomizing the molten alloy with nitrogen gas has been found to produce alloys powders having a high nitrogen content and a minimum amount of hollow particles. The resulting alloy powders which demonstrate superior mechanical properties and heat and chemical resistance are easily fabricated into articles utilizing powder metallurgical processes.

22 Claims, 7 Drawing Sheets

PRODUCING VOID-FREE METAL ALLOY POWDERS BY MELTING AS WELL AS ATOMIZATION UNDER NITROGEN AMBIENT

TECHNICAL FIELD

The present invention relates to a process for producing nitrogenated alloys and articles from such alloys. In particular, the present invention relates to a gas atomization method for producing nitrogenated alloys which are subsequently processed by powder metallurgy methods.

BACKGROUND ART

Nitrogen-containing austenitic stainless steels have been developed as engineering materials in order to take advantage of their enhanced strength and resistance to corrosion as compared to non-nitrogenated alloys. In addition to having enhanced strength and resistance to corrosion, nitrogen-containing austenitic stainless steels retain their low temperature toughness and high weldability which is typical of austenitic stainless steels. Nitrogen-containing stainless steel are further less prone to sensitization and more suitable for high temperature exposure. These qualities and others make nitrogenated alloys, particularly stainless steels candidate materials for applications wherein moderately high strength, good corrosion and oxidation resistance, and high toughness are required of non-magnetic alloys.

Limiting factors in the application of nitrogenated alloys, particularly nitrogenated stainless steel alloys is the difficulty of incorporating a controllable, homogeneous concentration of nitrogen into the metal. Current methods include melting and casting austenitic stainless steels alloys under high pressure nitrogen. In such cases, the cast ingot is processed in much the same manner as any casting method: drawing, rolling, or other forming operations are necessary to attain desirable shape.

Other methods of producing nitrogenated alloys include adding nitrogenous materials to the slag during electro-slag remelting.

Other general methods of processing metal alloys which are not concerned with nitrogenation include gas atomization or powder metallurgy in which alloy melts are atomized in various gaseous environments.

Hede U.S. Pat. No. 4,340,432 discloses a method of manufacturing stainless ferritic-austenitic steel which involves preparing a melt of steel with a nitrogen content higher than about 0.10 percent and an austenitic content of not less than 20 percent. The melt is subjected to gas atomization to form a powder which is compacted by an isostatic or semiisostatic compaction procedure to form a body which is heat treated and cooled. Hede discloses utilizing either nitrogen or argon during the gas atomization.

U.S. Pat. No. 3,891,730 to Wessel et al discloses a method for producing a metal powder which involves atomizing a hollow stream of molten metal, utilizing a pressurized fluid. Wessel et al do not disclose the selective use of nitrogen as an atomizing agent.

U.S. Pat. No. 4,919,854, to Walz, discloses a method and apparatus for producing superfine powder in spherical form with a diameter of about 5 to 30 microns in a Laval nozzle system. Walz discloses suitable inert gas propellants, specifically noting that nitrogen may be utilized with metals which do not form nitrides.

U.S. Pat. No. 4,448,746, to Kubo et al discloses a process for producing alloy steel powder, particularly low-oxygen, low-carbon alloy steel powder. The process involves atomizing a molten steel by means of an atomizing agent containing a non-oxidizing media. Kubo et al utilize an oil atomization process.

U.S. Pat. No. 3,658,311 to Di Giambattista et al discloses an apparatus for making a metal powder. However, Di Giambattista et al disclose the use of argon in their system.

U.S. Pat. No. 2,638,630 to Golwynne discloses a method for the production of a metal powder which specifically avoids nitrogen contamination.

Current gas atomization processes utilized to produce powders of various metal alloys generally utilize any arbitrary inert gas including argon and helium even though the use of certain inert gases such as argon and helium in a gas atomization process results in the formation of hollow gas-filled particles. Articles formed from metal powders which contain such hollow gas- filled particles disadvantageously have structural defects which contribute to shortened fatigue life and, ultimately, the failure of the component article or device.

The present invention is an improvement over the prior art which produces nitrogenated alloy powders while avoiding the formation of hollow gas-filled alloy particles.

DISCLOSURE OF THE INVENTION

It is accordingly, one object of the present invention to provide a method of gas atomization of a large variety of alloys which avoids the formation of hollow gas-filled alloy particles.

Another object of the present invention is to provide a method of producing a large variety of nitrogenated alloy powders.

A further object of the present invention is to provide a method of producing a large variety of nitrogenated alloy powders which have improved mechanical properties.

A further object of the present invention is to provide a method of producing articles from a large variety of nitrogenated alloys.

A still further object of the present invention is to provide a large variety of novel nitrogenated alloy powders and articles formed from such alloy particles.

Accordingly, the present invention provides for a method of producing a nitrogenated metal alloy powder which involves melting a metal alloy under a nitrogen containing atmosphere to increase the nitrogen content of the alloy and, thereafter subjecting the molten alloy to a gas atomization process in which nitrogen is utilized as the atomizing gas.

The present invention further provides for a method of fabricating a metal alloy article which comprises consolidating a nitrogenated metal alloy powder produced by: melting a metal alloy under a nitrogen containing atmosphere to increase the nitrogen content of the alloy; and thereafter subjecting the molten alloy to a gas atomization process in which nitrogen is utilized as the atomizing gas.

BRIEF DESCRIPTION OF DRAWINGS

Aspects of the present invention will be described with reference to the annexed drawings, which are given by way of non-limiting examples, in which.

BEST MODE FOR CARRYING OUT THE INVENTION

Figure 1:
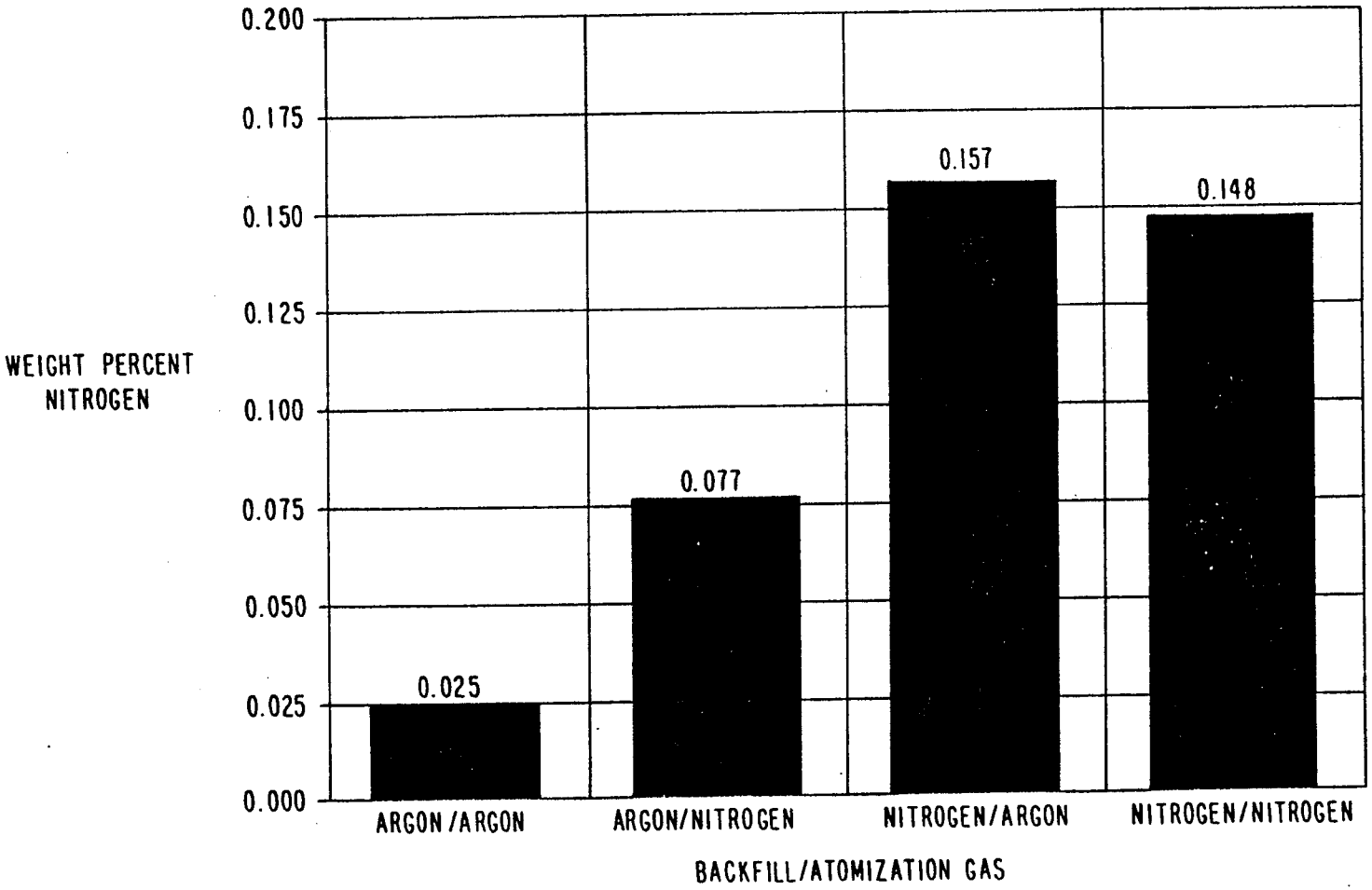
FIG. 1 is a bar graph of the weight percent of nitrogen for each of the first 4 samples listed in Table I.

The present invention relates to a process by which nitrogenated alloy powders with a minimum of hollow spheres can be produced by melting the base alloy in a nitrogen containing atmosphere and subsequently atomizing the molten alloy with nitrogen gas. Upon consolidation, the resulting alloy has improved mechanical properties compared to similar conventionally processed materials, e.g., those cast in a nitrogen atmosphere.

The process of the present invention has enabled the incorporation of up to 0.15 weight percent nitrogen into the alloy designated 304L (Fe, 0.3 wt. % C (maximum), 2.0 wt. % Mn (maximum), 1.0 wt. % Si (maximum), 18.0 to 20.0 wt. % Cr, and 8.0 to 12.0 wt. % Ni In addition, the process of the present invention has enabled the incorporation of up to 0.21 weight percent nitrogen into a modified version of 304L which contains 22 wt. % Cr. According to the present invention it has been discovered that atomizing with nitrogen, as opposed to helium or argon, reduces the formation of hollow gas-filled alloy particles.

The powdered alloy(s) formed by the present invention are easily formed into various articles by conventional compacting processes. According to the present invention, nitrogen induced into the alloy during melting and atomizing is retained in the alloy after the powder is consolidated utilizing a hot press, e.g., a hot isostatic press (HIP), a metal injection molding process or other powder metallurgy techniques. The nitrogen acts as a potent strengthener of the alloys, particularly austenitic alloys. For example, the modified 304L having 22 wt. % Cr and 0.21 wt. % N has approximately double the yield strength of stainless steel that was melted and atomized with argon and otherwise identically processed.

As will be shown below, the hardness, yield strength, and work-harding rate are all significantly (and linearly) increased by the addition of nitrogen in the range of nitrogen contents of the present invention. These findings indicate that the properties of powder metallurgy processed nitrogenated alloys, particularly stainless steels, are equivalent to materials fabricated utilizing other methods, such as melt casting. Inasmuch as the mechanical properties of the nitrogenated particles increases as a result of nitrogenation, the advantages of utilizing powder metallurgy becomes significant due to the fact that the consolidation processes utilized do not require the extent of machining which conventional casting processes require.

The present invention utilizes nitrogen gas as both an atmosphere for melting the base alloy and as an atomizing gas. The basic procedure according to the present invention involves evacuating the melt chamber to less than about 25 microns pressure and then back-filling the melt chamber with about 1 atmosphere of nitrogen gas. Higher pressures of the nitrogen could be used to increase nitrogen content. Likewise, nitrogen containing gases could also be used. Once the melt chamber is filled with nitrogen gas, the base alloy, e.g, steel (including stainless steel and austenitic stainless steel), nickel alloys (including nickel-based super alloys), aluminum alloy, or titanium alloy, is melted and brought to a super heated condition under the nitrogen atmosphere.

Upon super heating of the alloy in the nitrogen atmosphere, nitrogen is absorbed into the alloy or otherwise reacts with one or more elements in the alloy which forms a nitride. The nitrogen-containing alloy is thereafter gas atomized using nitrogen gas. The use of the nitrogen gas both during melting and gas atomization leads to additional nitration of the alloy and minimizes the formation of hollow powder particles which are conventionally produced during gas atomization processes which utilize other inert gases such as argon or helium. The combined effect of nitration together with the reduction of hollow powder particles results in improved mechanical property improvements of articles which are subsequently produced by consolidating the metal powder.

The powdered nitrogenated alloys of the present invention have been found to be useful in powder metallurgy processes and provide advantages over conventional casting processes. The powder metallurgy processing method of the present invention consolidates the nitrogen-containing alloy powder(s) (typically smaller than 100 μm in diameter) into a bulk material or article. This powder metallurgy method leads to materials with a finer microstructure scale and near-net-shape capabilities not achievable by casting methods. Moreover, the nitrogenated alloys prepared by the method of the present invention have been found to have a superior chemical homogeneity which provides for a more uniform product.

In contrast to the present invention which is capable of producing metal alloy particles having diameters of up to about 100 μm which contain less than about 1% hollow particles, prior methods of powder metallurgy which utilize gas atomization generally require screening steps to remove particles which have diameters greater than 50μm in order to insure removal of hollow particles.

By being applicable to a variety of alloys in which there is (a) solubility of nitrogen in the liquid and/or solid metal or (b) as element(s) present in the alloy which forms nitrides, the present invention provides a large variety of nitrogenated alloys which can be produced in powder form and subsequently utilized advantageously in powder metallurgy methods. In addition to the above benefits, melting and the gas atomization process of the present invention has been found to produce a metallurgically cleaner produce than that produced by other conventional processes.

The following examples are presented to illustrate the invention which is not intended to be considered as being limited thereto. In the examples and throughout, percentages are by weight unless otherwise indicated.

EXAMPLE 1

In this Example a sample of 304L alloy was melted and atomized utilizing different combinations of process gas atmospheres. The nitrogen content as a function of the process parameters is listed in Table I below.

TABLE I

| Melt Backfill Gas | Atomizing Gas | Wt. % Nitrogen |
|---|---|---|
| Argon | Argon | 0.025 |
| Argon | Nitrogen | 0.077 |
| Nitrogen | Argon | 0.157 |
| Nitrogen | Nitrogen | 0.148 |
| Nitrogen | Nitrogen | 0.206* |

*22 wt. % Cr 304L alloy

From the data in Table I it is observed that melting under a nitrogen atmosphere has a greater effect on the wt. % of nitrogen in the final alloy than atomizing with nitrogen. However, atomizing with nitrogen did contribute to the wt. % nitrogen in the final alloy. The results of this example are further illustrated in FIG. 1 which is a bar graph of the weight percent of nitrogen for each of the first 4 samples listed in Table I.

EXAMPLE 2

In this example samples of 304L alloy produced utilizing the different combinations of process gas atmospheres of Example 1 above were investigated for the formation of hollow particles. FIGS. 2*a*–2*e* are photomicrographs of the stainless steel powder samples. The legends in FIGS. 2*a*–2*e* indicate the combination of process gases utilized. The first gas listed in the legend is the melt backfill gas and the second listed gas is the atomizing gas.

Figure 2C:
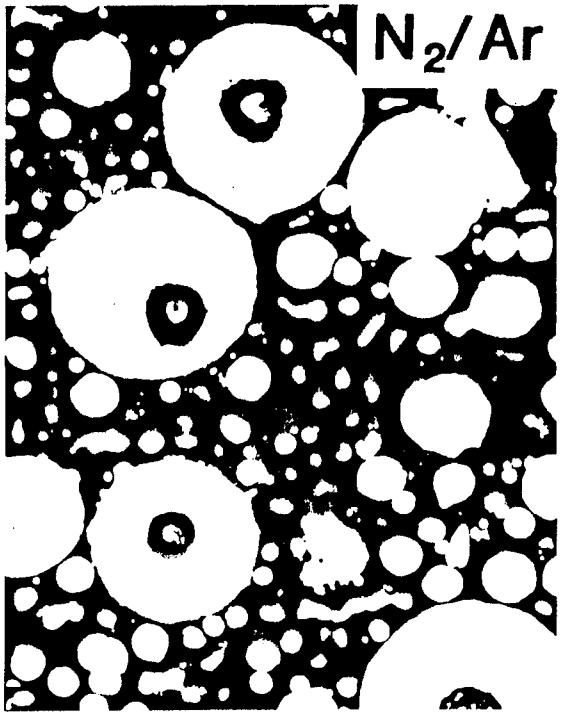
FIGS. 2a-2e are photomicrographs of gas atomized stainless steel powders which were produced utilizing different combinations of process gas atmospheres.
Figure 2B:
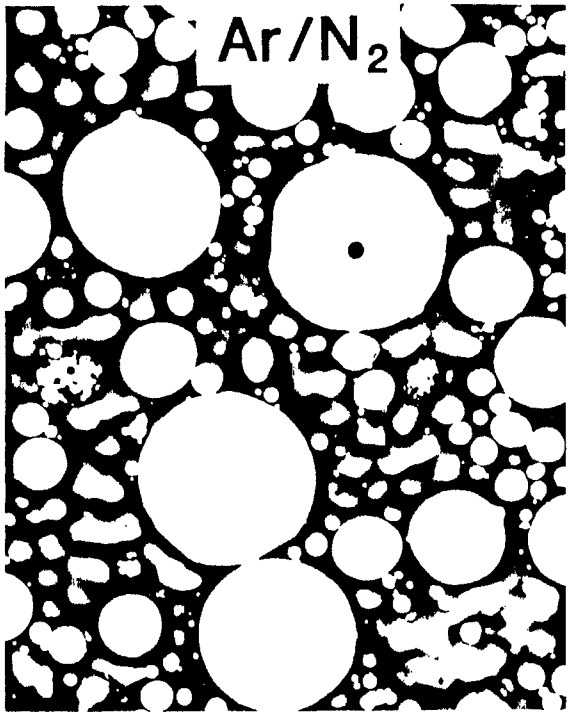
Figure 2A:
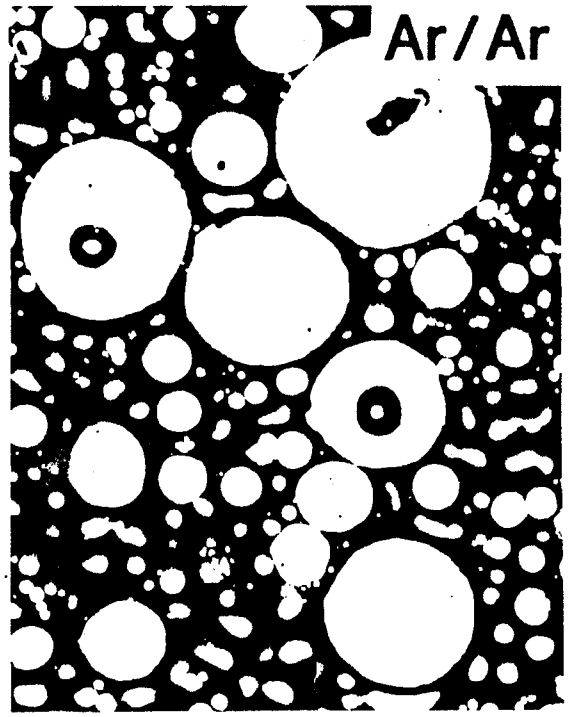
Figure 2E:
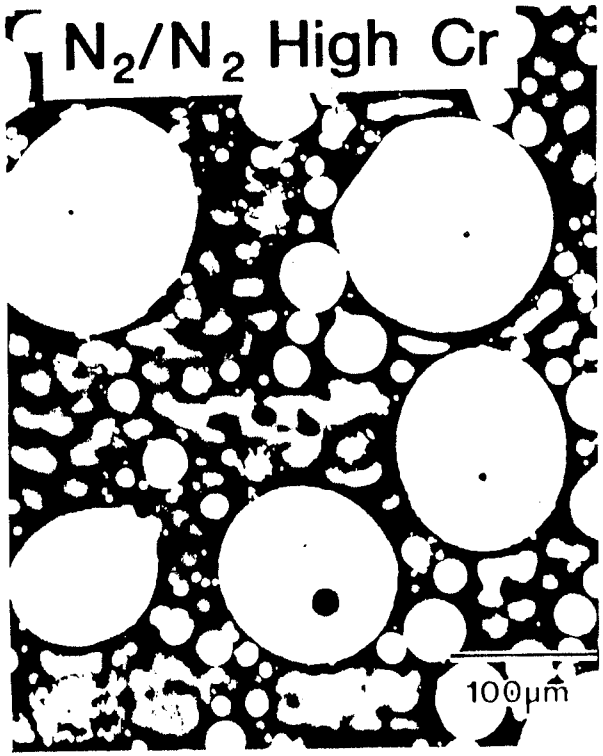
Figure 2D:
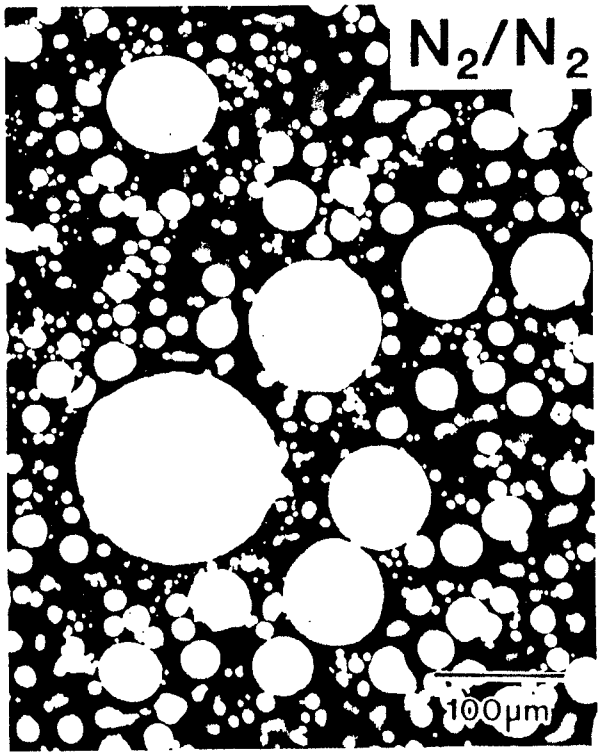

As illustrated in FIGS. 2*a* and 2*c*, a number of the argon atomized stainless steel particles were hollow as shown by the dark areas in the center of the particles. In contrast, the nitrogen atomized stainless steel particles illustrated in FIGS. 2*b*, 2*d* and 2*e* contained essentially no hollow particles.

This result indicates that the critical factor in reducing the number of hollow particles is the process gas utilized in the gas atomization step.

Figure 3:
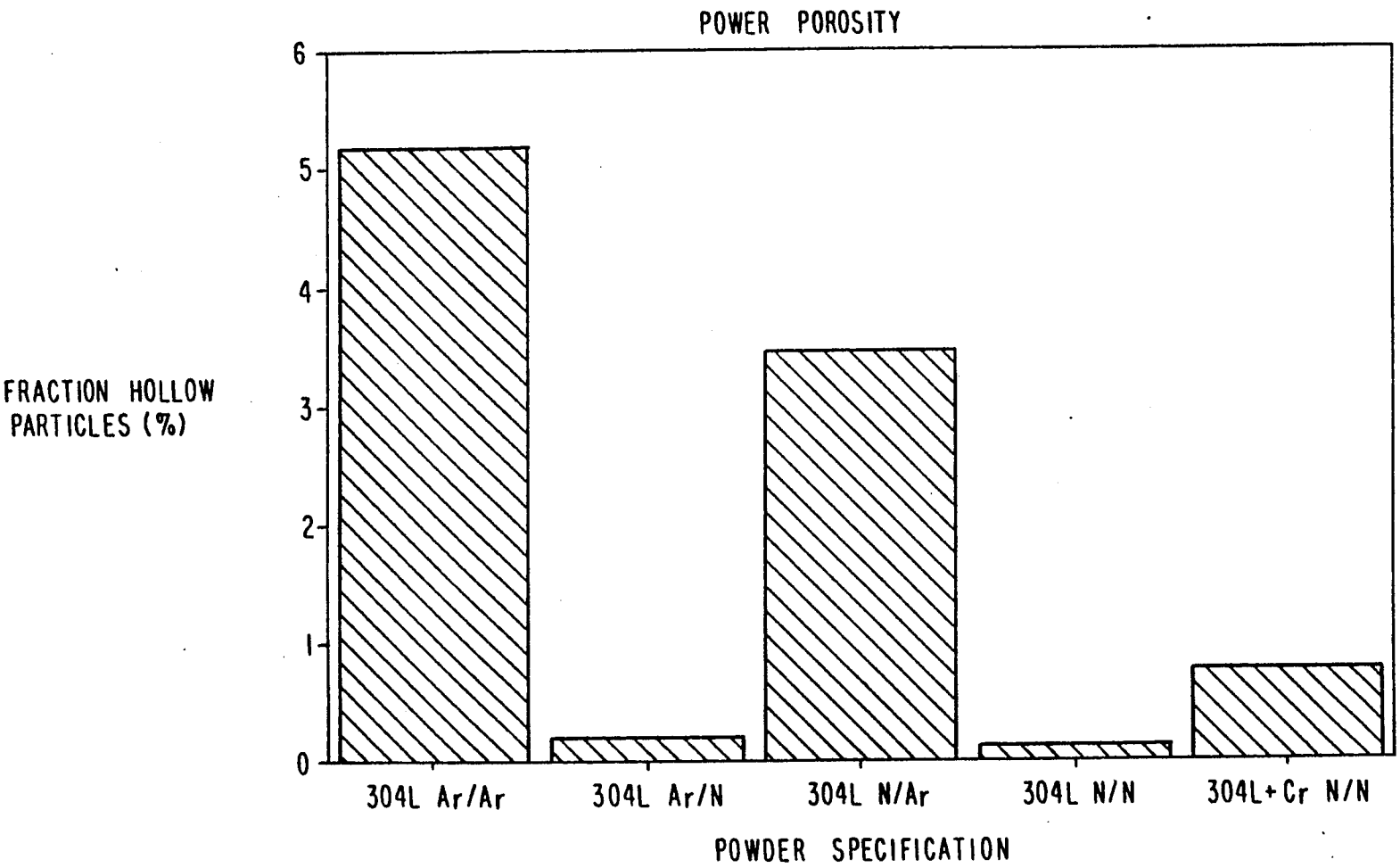
FIG. 3 is a bar graph of the fraction of hollow particles (%) for each of the different combination of process gases of Example 2.

The results of this example are further illustrated in FIG. 3 which is a bar graph of the fraction of hollow particles (%) for each of the different combination of process gases.

EXAMPLE 3

In this example samples of 304L alloy produced utilizing the different combinations of process gas atmospheres of Example 1 above were investigated for mechanical properties. The samples were compacted utilizing a hot isostatic press and tested for yield stress (0.2%), flow stress (5%), and hardness.

Figure 4:
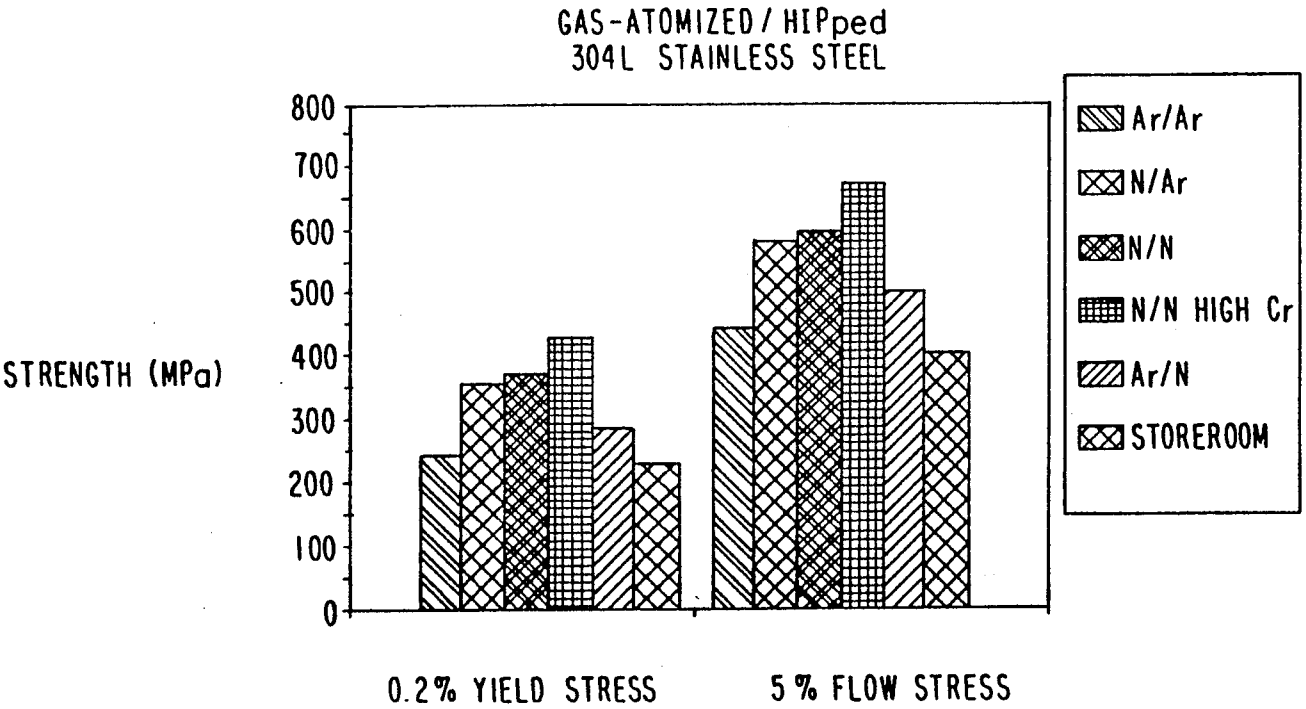
FIG. 4 is a bar graph illustrating the 0.2% yield stress and 5% flow stress of 304L stainless steel as a function of processing parameters.

FIG. 4 is a bar graph illustrating the 0.2% yield stress and 5% flow stress of the 304L stainless steel samples as a function of strength and processing parameters. In FIG. 4 the first gas listed in the legend is the melt backfill gas and the second listed gas is the atomizing gas. The material designated storeroom is a comparable commercially available stainless steel which was not processed by powder metallurgy methods.

As observed from FIG. 4, the samples processed with both a nitrogen melting atmosphere and with nitrogen as the atomizing gas demonstrated superior yield stress and superior flow stress. Moreover, the sample melted under a nitrogen atmosphere and atomized with argon showed a significant increase in yield strength and flow stress.

Figure 5:
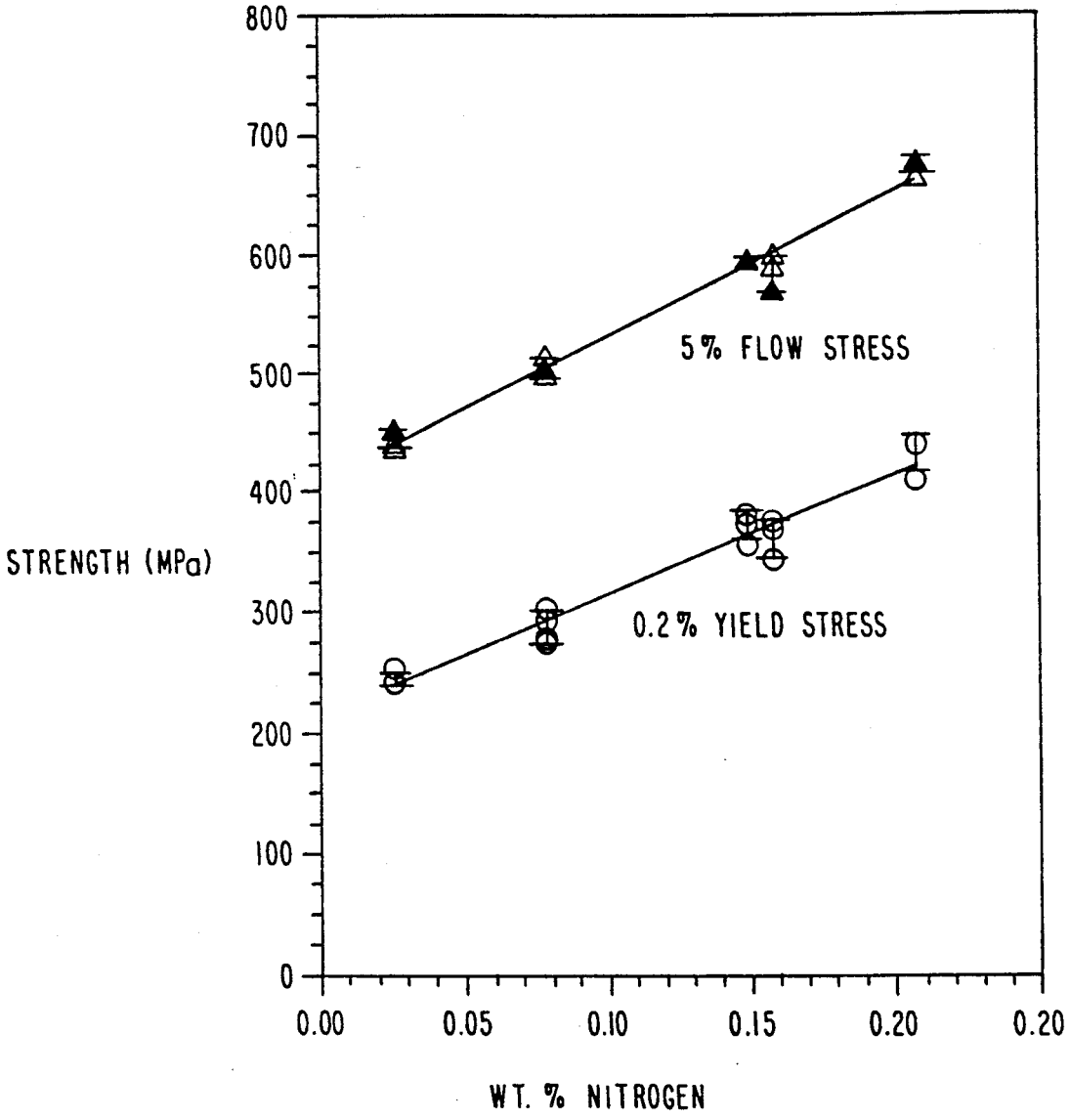
FIG. 5 is a graph of the 0.2% yield stress and 5% flow stress of powder metallurgy processed stainless steel as a function of nitrogen content.
Figure 6:
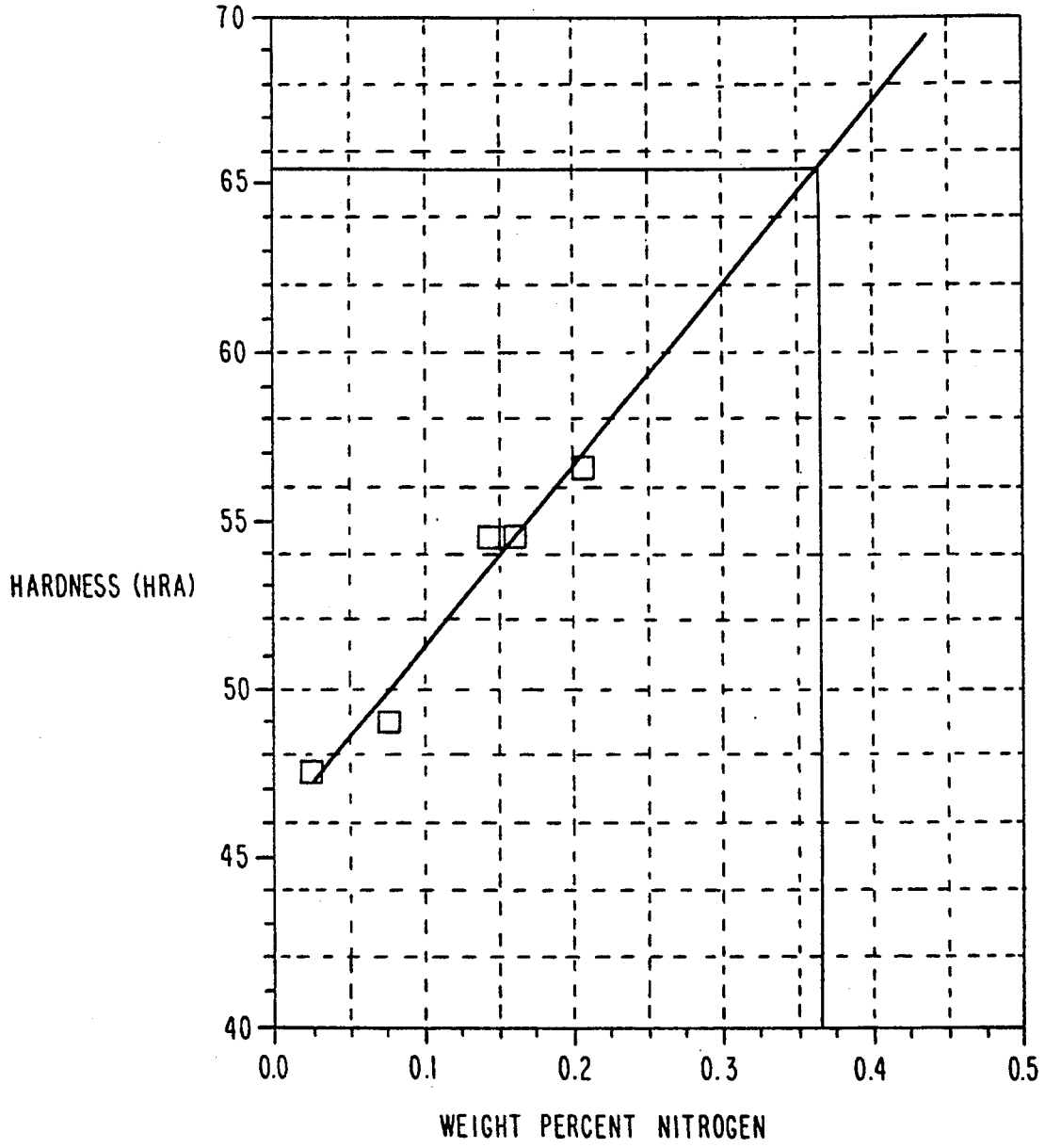
FIG. 6 is a graph of the hardness of powder metallurgy processed stainless steel as a function of nitrogen content.

The results of this example are further illustrated in FIG. 5 and 6 which are graphs of the 0.2% yield stress and 5% flow stress of the powder metallurgy processed stainless steel as a function of nitrogen content, and of hardness of the powder metallurgy processed stainless steel as a function of nitrogen content.

As illustrated in FIGS. 5 and 6, the yield stress, flow stress, and hardness increase linearly with nitrogen content.

The results of the above examples indicate that in order to produce a powder alloy having a high nitrogen content and a minimum amount of hollow particles it is necessary to utilize nitrogen both as the melt backfill and as the atomizing gas in the gas atomization step. As noted above, utilizing nitrogen as the melt backfill insures that a significant amount of nitrogen is added to the alloy. On the other hand, utilizing nitrogen for the atomizing gas in the gas atomization step insures a minimum formation of hollow particles. In this regard, it is believed that during gas atomization, the nitrogen in any nitrogen bubbles created during gas atomization is adsorbed into the metal alloy an quenched in the powder due to the high cooling rate and fine particle size characteristic of gas atomization. In contrast, utilizing argon or helium would cause the formation of hollow particles since these gases are not adsorbed by the alloy. Therefore, it is possible according to the present invention to melt an alloy under any atmosphere, including argon, helium, nitrogen, etc., and still avoid or reduce the formation of hollow particles by performing gas atomization utilizing nitrogen as the atomixing gas.

Although the invention has been described with reference to particular means, materials and embodiments, from the foregoing description, one skilled in the art can easily ascertain the essential characteristics of the present invention and various changes and modifications may be made to adapt the various uses and conditions without departing from the spirit and scope of the present invention as described by the claims which follow.

We claim:

1. A method of producing a nitrogenated metal alloy powder which comprises the following steps:

(a) melting a metal alloy under a nitrogen atmosphere to increase the nitrogen content of said alloy and thereafter (b) subjecting said molten alloy to a gas atomizing process to produce solid, substantially spherical shaped nitrogenated metal alloy particles, wherein nitrogen is utilized as the atomizing gas in said gas atomizing process and said gas atomization process is controlled so that nitrogen provided to increase said nitrogen content in step (a) is absorbed into the resulting metal alloy particles.

2. A method of producing a nitrogenated metal alloy powder according to claim 1, wherein said nitrogen containing atmosphere utilizing during the melting is at a pressure of about 1 atmosphere.

3. A method of producing a nitrogenated metal alloy powder according to claim 1, wherein less than about 1 percent of the metal alloy powder particles produced by the gas atomization step include hollow particles.

4. A method of producing a nitrogenated metal alloy powder according to claim 1, wherein said metal alloy is selected from the group consisting of steels, nickel alloys, aluminum alloys and titanium alloys.

5. A method of producing a nitrogenated metal alloy powder according to claim 1, wherein said metal alloy includes one or more elements which are capable of reacting with nitrogen to form a nitride.

6. A method of producing a nitrogenated metal alloy powder according to claim 1, wherein the average particle size of the resulting metal alloy powder is less than about 100 μm.

7. A method of producing a nitrogenated metal alloy powder according to claim 1, wherein more that about 30–50 percent of said nitrogenated metal alloy particles rae greater than about 10 μm.

8. A method of producing a nitrogenated metal alloy powder according to claim 4, wherein said metal alloy is stainless steel.

9. A method of producing a nitrogenated metal alloy powder according to claim 4 wherein said metal alloy is a nickel-based super alloy.

10. A method of producing a nitrogenated metal alloy powder according to claim 8, wherein said metal alloy is austenitic stainless steel.

11. A method of producing a nitrogenated metal alloy powder according to claim 10, wherein said austenitic stainless steel comprises 0.3 wt. % C; 2.0 wt. % Mn; 1.0 wt. % Si; 18.0 to 22.0 wt. % Cr; 8.0 to 12.0 wt. % Ni and a balance of Fe prior to melting and includes up to about 0.21 wt. % nitrogen after the gas atomization step.

12. A method of fabricating a metal alloy article which comprises consolidating a nitrogenated metal alloy powder produced by:

(a) melting a metal alloy under a nitrogen atmosphere to increase the nitrogen content of said alloy; and thereafter (b) subjecting said molten alloy to a gas atomization process to produce solid, substantially spherical shaped nitrogenated metal alloy particles, wherein nitrogen is utilized as the atomizing gas in said gas atomizing process and said gas atomization process is controlled so that nitrogen provided to increase said nitrogen content in step (a) is absorbed into the resulting metal alloy particles.

13. A method of fabricating a metal alloy article according to claim 12, wherein said nitrogenated metal alloy powder is consolidated by a hot isostatic pressing or injection molding process.

14. A method of fabricating a metal alloy article according to claim 12, wherein less than about 1 percent of the metal alloy powder particles produced by the gas atomization step include hollow particles.

15. A method of fabricating a metal alloy article according to claim 12 wherein said metal alloy is selected from the group consisting of steels, nickel alloys, aluminum alloys and titanium alloys.

16. A method of fabricating a metal alloy article according to claim 12, wherein said metal alloy includes one or more elements which are capable of reacting with nitrogen to form a nitride.

17. A method of fabricating a metal alloy article according to claim 12, wherein the average particle size of the resulting metal alloy powder is less than about 100 μm.

18. A method of fabricating a metal alloy article according to claim 12, wherein more that about 30–50 percent of said nitrogenated metal alloy particles are greater than about 10 μm.

19. A method of fabricating a metal alloy article according to claim 15, wherein said metal alloy is stainless steel.

20. A method of fabricating a metal alloy article according to claim 15 wherein said metal alloy is a nickel-based super alloy.

21. A method of fabricating a metal alloy article according to claim 19, wherein said metal alloy is austenitic stainless steel.

22. A method of fabricating a metal alloy article according to claim 21 wherein said austenitic stainless steel comprises 0.3 wt. % C; 2.0 wt. % Mn; 1.0 wt. % Si; 18.0 to 22.0 wt. % Cr; 8.0 to 12.0 wt. % Ni and a balance of Fe prior to melting and includes up to about 0.21 wt. % nitrogen after the gas atomization step.

* * * * *